United States Patent [19]

Klein

[11] 4,355,935

[45] Oct. 26, 1982

[54] METHOD OF FORMING A CAN END HAVING A VENTED GATE WITHIN A PUSH-DOWN APERTURE

[76] Inventor: Gerald B. Klein, 13451 Stuart Ct., Broomfield, Colo. 80020

[21] Appl. No.: 166,966

[22] Filed: Jul. 8, 1980

Related U.S. Application Data

[62] Division of Ser. No. 63,792, Aug. 6, 1979, Pat. No. 4,244,489.

[51] Int. Cl.[3] ..... B21D 51/44

[52] U.S. Cl. ..... 413/17

[58] Field of Search ..... 220/268; 113/1 F, 116 V, 113/116 Y, 121 AB, 121 C, 121 R; 413/12, 15, 17, 67

[56] References Cited

U.S. PATENT DOCUMENTS

| | | | |
|---|---|---|---|
| 3,794,206 | 2/1974 | DeLine et al. | 220/268 |
| 3,888,199 | 6/1975 | Herrmann | 113/121 C X |
| 4,105,134 | 8/1978 | De Benham et al. | 220/268 |

*Primary Examiner*—Mark Rosenbaum

*Attorney, Agent, or Firm*—Dennis O. Kraft

[57] ABSTRACT

A can end having a push-down gate for opening a can to which the end is affixed and having a push-down gate vent in the primary gate adapted to be opened before the gate is opened to relieve gas pressure from within the can.

4 Claims, 8 Drawing Figures

METHOD OF FORMING A CAN END HAVING A VENTED GATE WITHIN A PUSH-DOWN APERTURE

This is a divisional of application Ser. No. 63,792, filed Aug. 6, 1979, now U.S. Pat. No. 4,244,489 issued Jan. 13, 1981.

This invention relates to push-down gates in beverage can ends, and more particularly to pressure relief vents associated with the gates.

Gated can ends, wherein the gate is integral with the can end and is pushed downwardly and into the can, is exemplified by the U.S. Pat. No. 3,334,775 issued to myself and Kenneth E. Harper. This construction is commonly called a "triple-fold gate". Other types of gated can ends are also available and the general construction of a gated can end is to provide a gate which is slightly larger than and underlies an opening or aperture in the can end. The gate is hinged to the end at an edge portion of the opening and thus remains attached to the end when pushed downwardly into the can to open it. This feature, remaining attached to the can end when pushed downwardly into the can, is desirable because the gate is a small tab of sharp-edged material. Inside the can it is in an out-of-the-way, safe location, and non-detachable gates are required by some states.

Being slightly larger than the aperture, the gate cannot open by an upward movement out of the can. Thus, when a carbonated beverage, such as beer or a carbonated soft drink, is in the can, the pressure of the carbon dioxide against the inner side of the gate holds it tightly closed, so much so that it may be difficult for an individual to open the can by pushing against the gate with his thumb or a forefinger. To solve this problem, a vent may be used to relieve the pressure before the gate is pushed into the can.

A vent is essentially a small gate and several types are known. One type may be constructed the same as the triple-fold gate shown in patent No. 3,334,775. Another type of gate may be constructed by punching out a small, circular tab, offsetting it below the surface of the can end panel except at a hinge portion, enlarging the tab by a coining operation, and raising the center of the tab so that a surface is above the can end panel to facilitate pushing it downwardly. This tab is then sealed with a parafin base, hot melt adhesive or a plastisol. Attempts have been made to obtain internal pressure venting by weakening or predetermining a flexing point of the push-in tab of a single can end of the type shown in U.S. Pat. No. 3,334,775, but these attempts have not produced ends which are satisfactory as regards opening pressure characteristics.

Vents, as separate small gates, are now located in the can end at the side opposite to the primary gate to minimize metal strains incurred in drawing and forming a can end having a gate and vent. The present invention places a small gate vent on the gate itself with the realization that significant use advantages are to be gained by such a construction. However, it was discovered and realized that the problem of metal strain in forming the can end, the gate and the vent must be considered. Forming a gate with a vent in it, that is, a gate within a gate, may be possible with some types of push-in gate tabs; however, this has not been considered, especially in a triple-fold gate. In the ordinary mode of manufacture, the end is drawn to some extent to form the peripheral radii of the unit and then severely drawn to form the triple-fold gate. Additional drawing could cause fractures or strains affecting the integrity of a significant percentage of the can ends. Manufacturing reliability could not be obtained. A second facet of the present invention thus resides in forming the end, with a vent in the gate, in a controlled manner to minimize the effects of metal strain.

It follows that the objects of the invention include a novel and improved arrangement of a gate vent on a push-down gate in a beverage can end which: permits a user to open the can by a single push against the gate, opening the vent and gate in a direct sequence; permits a gate tightly held closed by gas pressure to be more easily opened; permits the use of a vent on a can end where the form of a can is such that a vent cannot be located elsewhere; is formed by simple operations without creating excessive strain in drawing the metal; and, is a simple, reliable, low-cost operation.

With the foregoing and other objects in view, my invention comprises certain constructions, combinations and arrangements of parts and elements, and steps and sequences, as hereinafter described, defined in the appended claims and illustrated in the accompanying drawing, in which:

and

Figure 5:
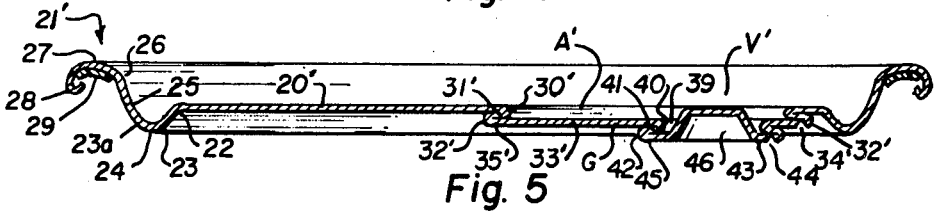
FIG. 5 is a sectional view of a can end similar to FIG. 4 but taken from the indicated line 5—5 at FIG. 2.
Figure 8:
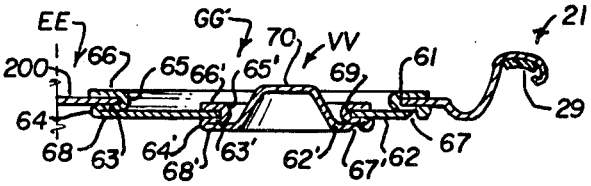

FIG. 8 is a fragmentary sectional detail, similar to a portion of FIG. 5 but showing another mode of forming a gate in an end and a vent in the gate.

Figure 1:
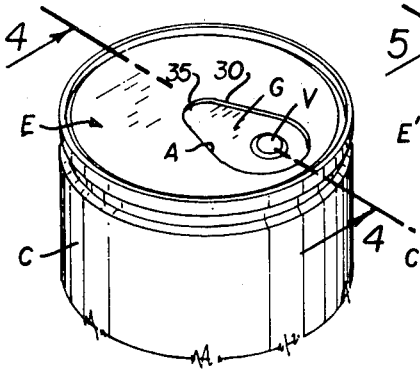
FIG. 1 is an isometric view of the upper portion of a can having an end with an elongated push-down gate and a small, push-down gate vent in the primary gate according to the present invention.
Figure 2:
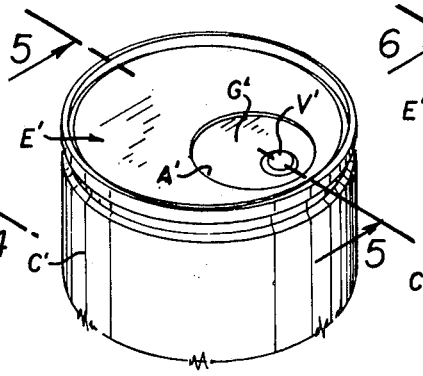
FIG. 2 is an isometric view of the upper portion of a can, similar to FIG. 1, but with a circular primary gate.
Figure 3:
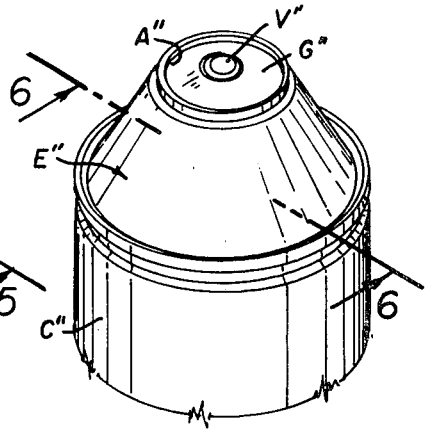
FIG. 3 is an isometric view of the upper portion of a can with a frustro-conical raised end, a circular push-down gate at the apex and a push-down gate vent at the center of the primary gate.

Referring more particularly to the drawing, the can C of FIG. 1 is closed by a flat panel end E having an elongated aperture A, a corresponding elongated triple-fold gate G beneath this aperture and a vent V in this gate. The can C′ of FIG. 2 is closed by a flat panel end E′ having a circular aperture A′, a corresponding circular triple-fold gate G′ beneath this aperture and a vent V′ in this gate. The can C″ of FIG. 3 is closed by a conical end E″ having a circular aperture A″ at its apex end, a triple-fold gate G″ beneath this aperture and a vent V″ in this gate.

Figure 4:
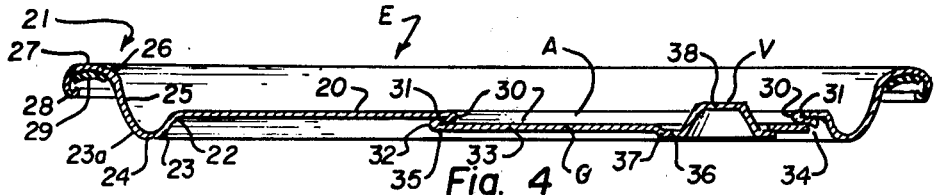
FIG. 4 is a sectional view of a can end as taken from the indicated line 4—4 at FIG. 1 but on an enlarged scale and showing the end before it is seamed onto the body of the can.
Figure 6:
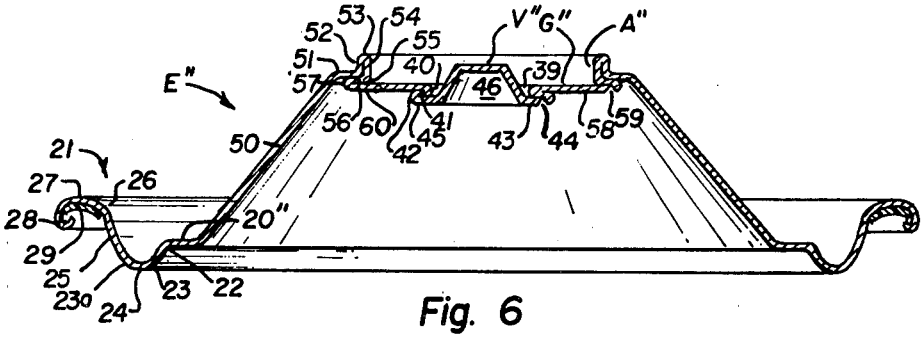
FIG. 6 is a sectional view of a can end similar to FIG. 4 but taken from the indicated line 6—6 at FIG. 3.

Certain conventional features of these can ends E, E′ and E″ are similar. Referring to FIGS. 4, 5 and 6, each can end before being seamed to a cylindrical can wall, includes a flat, circular expansion panel 20 wherein the gates and the cone of end E″ are formed, and peripheral seaming and strengthening radii 21 circumscribing the panel 20. The peripheral radii 21 includes a short downturned expansion radius 22 which turns to a chuck panel radius 23 having its bottom forming a chuck panel 24. An outward chuck panel radius 23*a* turns to an upwardly extended chuck wall 25. The upper crest of this chuck wall turns outwardly to a seaming panel radius 26 from whence a circular seaming panel 27 outstands, with the outward edge of the seaming panel being downturned to form a curl 28. A latex-type seaming compound 29 is provided at the inner under portion of the seaming panel 27 to complete the connective circular edge 21. The formation of the circular edge 21 is conventional and need not be further described.

The elongated triple-fold gate G in the end of FIGS. 1 and 4 is formed by a down draw from the expansion panel 20 to define the aperture A. The edge portion of this down draw is then folded underneath the aperture to produce an aperture fold 30, a spacer strip 31, a reverse underfold 32 and a gate panel 33 below the spacer strip. The gate G is defined in the panel 33 by a cut or a score line 34 opposite strip 31 and adjacent to the reverse underfold 32 to underline the aperture. The score line 34 extends continuously about the panel except at a short hinge 35 as will be described. This aperture A is elongated and radially disposed in the circular expansion panel 20. It is illustrated as being generally pie-shaped with curved ends, a narrow end at the center of the panel 33 and the wide end adjacent to the edge of the panel. The hinge 35 may be located at the central narrow end of the aperture to connect the gate with the panel 20.

The vent gate V is preferably located at the wider end of the gate and aperture. The vent gate may be formed in the gate panel 33 before or during the forming of the gate, and before the score line 34 is cut. The vent V is formed by punching out a circular blank 36 of metal to sever the blank from the gate panel 33 except at a short offset hinge point 37. This permits the blank to be positioned below the vent orifice in the gate. The blank 36 is then squeezed, as by coining, to enlarge its diameter. At the same time, a dome 38 is drawn in the center of the blank to extend above the gate panel 33 where it can be easily reached and opened by finger pressure.

To complete this end, the score line 34, preferably cut through the metal, and the edge of the vent are sealed from leaking by the ue of a parafin base, hot melt adhesive or a plastisol, not shown, such as disclosed in U.S. Pat. Nos. 3,905,513 and 3,980,200.

The circular triple-fold gate G of FIGS. 2 and 5 is, in many respects, similar to the gate G of FIGS. 1 and 4 excepting that the aperture and gate are circular in form and the pressure vent gate is a triple-fold type. The gate is formed by a down draw from the expansion panel 20 to define the aperture A′ and there is produced an aperture fold 30′, a spacer strip 31′, a reverse underfold 32′ and a circular gate panel 33′ below the spacer strip. The gate G′ is defined in the panel 33′ by a score line 34′ which extends continuously about the panel except at a short hinge 35′. The circular aperture is located at one side of the expansion panel for convenience of pouring and the hinge 35′ may be located adjacent to the center of the end or elsewhere. Also, the hinge 35′ may be located in a triple-fold portion as shown, such being preferable because of the circular symmetry of the gate.

The vent V′ is shown as being at one side of the circular gate E, but such a location is optional. This vent is formed below the gate using the triple-fold arrangement. As such, the vent orifice 39 is defined by a circular aperture fold 40. A spacer strip 41 is below the gate surface and a reverse underfold 42, to form a circular vent panel 43, is below the spacer strip. The vent is defined in the circular panel 43 by a score line 44 which extends continuously about the panel except at a short hinge 45. It is to be noted that the placement of the hinge 45 is optional and may be positioned opposite to the hinge of the gate G′. To complete the vent V′, a dome 46 is drawn in the panel 43 to extend above the gate panel 33′ so it can be easily reached and opened by finger pressure.

It is to be noted that variations of push-down gates in a flat can end are possible other than the two units described at FIGS. 1 and 4 and 2 and 5. Also, in conventional drawing procedures where the can end is formed, it is to be noted that a gate can be formed only with difficulty because of metal stretch encountered, first in drawing the peripheral seaming and strengthening radii, followed by drawing the triple-fold of the gate. Adding a vent in the gate panel such as herein described involved an excessive amount of draw, to the point where it has not even been considered.

I have discovered, however, that if the teaching of my U.S. Pat. No. 4,119,050 is followed, that is, to form a gate in a blank of metal which will subsequently form the can end, a vent in the gate can be easily provided.

Figure 7:
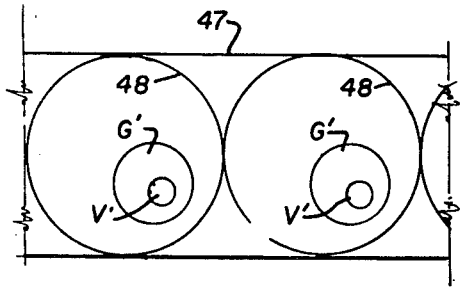
FIG. 7 is a fragmentary view, on a small scale, of a strip of metal wherefrom a series of ends having gates with vents may be formed, the gates and vents being formed before circular plates are cut out of the strip to form the ends.

Thus, as shown at FIG. 7, a strip of metal 47, where blanks for ends are to be cut, as indicated by circular outlines 48, a gate G′ and a vent V′ are formed first. By suitable indexing of the strip movement, blanks for the can ends are then cut out and the peripheral radii 21 then formed.

The conical end E″ shown at FIGS. 3 and 6 may have an expansion panel 20″ wherein the frustum of a cone 50 is drawn. The peripheral radii 21 is the same as heretofore described and it is to be noted that the cone 50 may upstand from the panel 20″ a short distance from the expansion radius 22 to provide a ring-like flat portion of the panel 20″ about the cone.

The gate G″ is at the flat apex end 51 of this cone 50. The end 51, a shoulder, tops the cone. An upstanding lip 52, topped by a reverse fold 53, forms a ring about the shoulder. The inner wall 54 of this lip 52 defines the aperture A″. The base of the inner wall turns outwardly as at an aperture fold 55 to form a spacer strip 56 underneath the shoulder 51. An underfold 57 at the periphery of the spacer strip 56 underneath the shoulder 51, defines the gate panel 58. A score line 59 in this panel opposite the spacer strip defines the gate G″ and this score line extends completely about this panel except for a short portion to form a hinge 60.

The vent V″ is at the center of the gate and is shown as being essentially the same as the vent V′ of FIG. 5. The vent is formed below the gate, the orifice 39 thereof being formed by an aperture fold 40 with a spacer strip 41 below the gate surface and a reverse underfold 42 placing the vent panel 43 under the spacer strip. The vent is defined in the panel 43 by a score line 44 which extends continuously about the panel except for a short hinge 45. A dome 46, for engaging and pressing against the vent, completes the unit.

It is to be noted that variations of this conical end are possible. For example, the lip 52 about the shoulder 51 may be eliminated so that the shoulder 51 extends directly into the aperture fold 55. Also, the gate G″ is shown as being flat while actually it may be convex or concave to enhance its rigidity where such is desired.

While the gate and vent of the conical end can be first formed in a metal strip 47, FIG. 7, the gate and vent can also be drawn in a flat panel end unit using a conventional conversion press to form the cone. I have ascertained that where a conical end is symmetrical about the central axis of the can, the drawing operations are far easier than the draw in a flat end even though the metal stretch may be far more extensive. There is more available metal to draw from without disturbing the peripheral radii 21. Also, with the balance in metal stretch provided by axial symmetry, the end with a lip 52, triple-fold gate G″ and a vent V″ can be easily drawn and formed.

The axial symmetry calls for placing the vent V″ in the center of the gate G″ and such provides an important advantage in that a sealant at the gate score line 59 and a second sealant at the vent score line 44 can both be applied at the same time as the circular seaming panel sealing compound 29, as while the end is being rotated with respect to the sealing applicators.

The construction shown at FIG. 8 shows an end EE where an expansion panel 200 has standard peripheral radii 21 but with a gate GG formed as a separate member fitted into an orifice in the expansion panel 200. The gate panel 62 is formed with a spacer strip 63 folded over the panel by an underfold 64. The spacer strip 63 is at the underside of the expansion panel 200 and about the orifice 61. An overfold 65, at the inner side of the spacer strip, extends through the orifice 61 and an overstrip 66, connected to the overfold, overlies the panel 200. A score line 67 in the panel 62, adjacent to the underfold 64, extends about the panel except for a short hinge 68 at one side thereof.

The vent VV is formed in an orifice 69 in the gate panel 62 and is essentially the same as the gate but on a smaller scale, including a vent panel 62′, a spacer strip 63′, an underfold 64′, an overfold 65′, an overstrip 66′, a score line 67′ and a hinge 68′, arranged as above described. In addition, the vent panel is drawn upwardly to form a dome 70 to facilitate pressing the vent downwardly.

I have now described my invention in considerable detail. However, it is obvious that others skilled in the art can build and devise alternate and equivalent constructions which are nevertheless within the spirit and scope of my invention. Hence, I desire that my protection be limited, not by the constructions illustrated and described, but only by the proper scope of the appended claims.

What is claimed is:

1. The method of forming a can end having a push-down multiple-fold primary aperture with a gate panel therebeneath for opening a can to which the end is affixed and having a push-down multiple-fold gated secondary venting aperture within said primary aperture for relieving pressure in a can before it is opened, said method including the steps of:

(a) providing a metal sheet wherefrom metal end blanks are cut;

(b) establishing the location of a circular end on the metal sheet;

(c) establishing, within said location, selected positions for a primary aperture and for a secondary venting aperture within the primary aperture;

(d) forming said multiple-fold primary aperture with a gate panel therebeneath in the metal sheet;

(e) forming said multiple-fold gated secondary venting aperture within said primary aperture; and (f) thereafter cutting out the blank and finishing the end.

2. The method defined in claim 1, wherein a score line is cut about at least a portion of the periphery of the primary aperture to define the gate panel therebeneath after the secondary venting aperture is formed.

3. The method defined in claim 2, further including the step of drawing the metal sheet into a frusto-conical shape with the primary aperture axially centered therein.

4. The method defined in claim 1, further including the step of drawing the metal sheet into a frusto-conical shape with the primary aperture axially centered therein.

* * * * *